US008203284B2

(12) United States Patent
Peeters et al.

(10) Patent No.: US 8,203,284 B2
(45) Date of Patent: Jun. 19, 2012

(54) DRIVING LIGHT EMITTING DIODES

(75) Inventors: Henricus Marie Peeters, Eindhoven (NL); Roel Van Woudenberg, Eindhoven (NL); Petrus Johannes Bremer, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 281 days.

(21) Appl. No.: 12/593,308

(22) PCT Filed: Mar. 31, 2008

(86) PCT No.: PCT/IB2008/051196

§ 371 (c)(1),
(2), (4) Date: Sep. 28, 2009

(87) PCT Pub. No.: WO2008/120166

PCT Pub. Date: Oct. 9, 2008

(65) Prior Publication Data

US 2010/0102732 A1 Apr. 29, 2010

(30) Foreign Application Priority Data

Apr. 2, 2007 (EP) ..... 07105475

(51) Int. Cl.
*H05B 37/02* (2006.01)

(52) U.S. Cl. ..... 315/299; 315/185 R; 315/224; 315/302; 315/308

(58) Field of Classification Search ..... 315/185 R, 315/186, 209 R, 224, 291, 299, 302, 308; 345/102

See application file for complete search history.

(56) References Cited

U.S. PATENT DOCUMENTS

| | | | | |
|---|---|---|---|---|
| 7,058,373 | B2 | 6/2006 | Grigore | |
| 7,425,943 | B2 * | 9/2008 | Furukawa | 345/102 |
| 7,560,677 | B2 * | 7/2009 | Lyons et al. | 250/205 |
| 7,649,326 | B2 * | 1/2010 | Johnson et al. | 315/291 |
| 7,688,002 | B2 * | 3/2010 | Ashdown et al. | 315/291 |
| 7,781,979 | B2 * | 8/2010 | Lys | 315/185 S |
| 7,999,484 | B2 * | 8/2011 | Jurngwirth et al. | 315/247 |
| 2004/0041620 | A1 | 3/2004 | D'Angelo et al. | |
| 2005/0227640 | A1 | 10/2005 | Haque et al. | |
| 2005/0243022 | A1 | 11/2005 | Negru | |
| 2006/0038803 | A1 | 2/2006 | Miller et al. | |
| 2006/0181485 | A1 | 8/2006 | Kim et al. | |
| 2006/0221636 | A1 | 10/2006 | Ohashi et al. | |

FOREIGN PATENT DOCUMENTS

| | | | |
|---|---|---|---|
| DE | 10103611 | A1 | 8/2002 |
| EP | 0967590 | A1 | 12/1999 |
| EP | 1318701 | A2 | 6/2003 |
| GB | 2278717 | A1 | 12/1994 |
| WO | 02076150 | A1 | 9/2002 |

* cited by examiner

*Primary Examiner* — Thuy Vinh Tran
(74) *Attorney, Agent, or Firm* — Mark L. Beloborodov

(57) ABSTRACT

Disclosed is a driver that includes a main power supply that has outputs coupled across a string of light emitting diodes to supply a main current. A secondary power supply is coupled to a junction between successive light emitting diodes in the string to supply or withdraw a delta current from the junction. The delta current is at least five times smaller than the main current. A controller controls the secondary power supply to generate the delta current to obtain a desired spectral composition of the mixed light emitted by the string.

11 Claims, 3 Drawing Sheets

DRIVING LIGHT EMITTING DIODES

FIELD OF THE INVENTION

The invention relates to a driver for a string of series arranged light emitting diodes, to a system of a driver and the string of light emitting diodes, to a backlight unit for illuminating a display panel, to a system comprising the backlight unit and the display panel, and to a display apparatus comprising the backlight unit and the display panel.

BACKGROUND OF THE INVENTION

WO 02/076150 A1 discloses an apparatus which controls multiple light sources of which the light is mixed to obtain light of a predetermined color light. A processor compares the amount of light detected of each of the light sources with a desired amount and controls drivers of the light sources such that the light sources produce the desired light level. The light sources are three strings of red, blue and green light emitting diodes (further also referred to as LED's), respectively. Each string of LED's is driven by a separate switched mode power supply (further also referred to as SMPS). The color of the mixed light is controlled by controlling a power supplied by the three SMPS's. In an embodiment, a common SMPS is arranged in front of the three SMPS's which drive the differently colored LED strings. It is a disadvantage of the prior art apparatus that three SMPS's are required to be able to drive the differently colored LED strings such that their color point can be controlled.

SUMMARY OF THE INVENTION

It is an object of the invention to minimize the number of main power supplies required for driving the differently colored LED's while still being able to adjust the spectral composition of the resultant mixed light.

A first aspect of the invention provides a driver for a string of series arranged light emitting diodes as claimed in claim 1. A second aspect of the invention provides a system of a driver and the string of light emitting diodes as claimed in claim 6. A third aspect of the invention provides a backlight unit for illuminating a display panel as claimed in claim 9. A fourth aspect of the invention provides a system comprising the backlight unit and the display panel as claimed in claim 10. A fifth aspect of the invention provides a display apparatus as claimed in claim 11. Advantageous embodiments are defined in the dependent claims.

A driver in accordance with the first aspect of the invention drives a string of series arranged LED's. At least two LED's of the string emit light having different spectra. For example, the string may have two LED's of which one LED emits red light while the other LED emits blue light. LED's may also be referred to by its color, thus with a red LED is meant a LED which emits red light. The string may also have at least two substrings of LED's, the LED's of each one of the substrings have the same color or spectrum. For example, the string may have a series arrangement of 2 red LED's and 4 blue LED's. Alternatively, the string may have 3 types of LED's which emit blue, red and green light. With such a string it is possible to make white light. Alternatively, the string may comprise more than 3 types of LED's such as is usual in wide gamut displays.

The driver comprises a main power supply which has outputs coupled across the string of LED's to supply a main current to the string. A secondary power supply is coupled to at least one of the junctions between successive LED's in the string to supply or withdraw a delta current from the junction. A controller controls the secondary power supply to generate a value of the delta current such that a predetermined spectral composition of the mixed light emitted by the string is obtained. The delta current is selected to be smaller than the main current. Consequently, the major part of the current through the series arranged LED's is supplied by the main power supply. The secondary power supply supplies the smaller delta current and thus is able to generate differences between the currents through the differently colored LED's. Thus, in contrast to the prior art wherein for each differently colored string of LED's a main power supply is required, in the present invention only a single main power supply is required for the LED's having different colors (or said more generally: emitting light having different spectra). Nevertheless, still the spectrum of the light can be varied or kept constant over time, such that a desired spectral composition of the mixed light is obtained, by controlling the current supplied or withdrawn by the relatively small secondary power supply.

The main power supply, which provides a base current through all the LED's of the string is able to control the overall light level, while the secondary power supplies are able to control the spectral composition of the light emitted by the string.

In an embodiment, the main power supply comprises or is a SMPS. Consequently, the majority of the current through the LED's is generated with high efficiency. The disadvantages of such a SMPS, which is bulky, expensive, slow and has ripple on the output voltage, are mitigated by the secondary power supplies. The secondary power supplies, which may be linear power supplies, need to supply a relatively small power, can be cheap, fast and can compensate for the ripple of the SMPS.

In an embodiment, the driver further comprising a sense resistor arranged in series with the string, and a comparator which compares a sensed voltage across the sense resistor with a reference voltage. The output signal of the comparator is used to obtain a control signal to control a main switch of the SMPS such that the main current is stabilized at a predetermined level. The predetermined level depends on the difference of the currents through differently colored LED's because only the common current can be supplied by the SMPS.

In an embodiment, the secondary power supply comprises a controllable linear power supply. Because the current supplied or drawn by the secondary power supply is much smaller than the current supplied by the first power supply, the low efficiency of the linear power supply is not a problem. The use of a linear power supply has the advantage that a fast and well defined variation of the current supplied is possible. Further, the ripple of a linear power supply is much lower than that of an SMPS. Thus, the use of the linear power supply has the advantage that the control of the spectral composition, which is predominantly determined by the difference of the currents through different colored LED's, can be controlled very accurately.

In an embodiment, the linear power supply comprises a controllable current source. Such a current source can be implemented in an integrated circuit by a current mirror.

In an embodiment, the string comprises at least three differently colored LED's to cover a color gamut including white light. The controller controls the secondary power supply to change the delta current to obtain a predetermined white color point. To have complete freedom in controlling the white color point, the ratio of all three currents through all three differently colored LED's should be controllable.

Therefore, a further secondary power supply has been added which is connected to another junction than the already mentioned junction. Because only the white point has to be varied or kept constant, the current generated by the secondary power supplies can be much smaller than the current through the main power supply.

In an embodiment, the system further comprises a further string of series arranged light emitting diodes of which at least two emit light having different spectra. A further main power supply has outputs coupled across the further string to supply a further main current to the further string. A further secondary power supply is coupled to at least one of the junctions between successive light emitting diodes in the further string to supply or withdraw a further delta current from the junction. The further delta current is at least a factor 10 smaller than the further main current. The controller also controls the further secondary power supply to change the further delta current to obtain a predetermined spectral composition of the mixed light emitted by the further string. Thus, for each string only one main power supply is required instead of three main power supplies. Especially if many strings are present, the power supply system in accordance with this embodiment of the present invention is much simpler. For example if 300 (100 for each color) strings of series arranged LED's are present in a prior art backlight for an LCD, also 300 relatively large controllable SMPS's are required. In the embodiment in accordance with the present invention only 100 relatively large main power supplies are required and 200 relatively small secondary power supplies.

The present invention can be advantageously implemented in a backlight unit for illuminating a display panel such as for example a LCD (liquid crystal display). Such a backlight unit and display panel combination can be implemented in a display apparatus.

These and other aspects of the invention are apparent from and will be elucidated with reference to the embodiments described hereinafter.

It should be noted that items which have the same reference numbers in different Figures, have the same structural features and the same functions, or are the same signals. Where the function and/or structure of such an item has been explained, there is no necessity for repeated explanation thereof in the detailed description.

DETAILED DESCRIPTION

Figure 1:
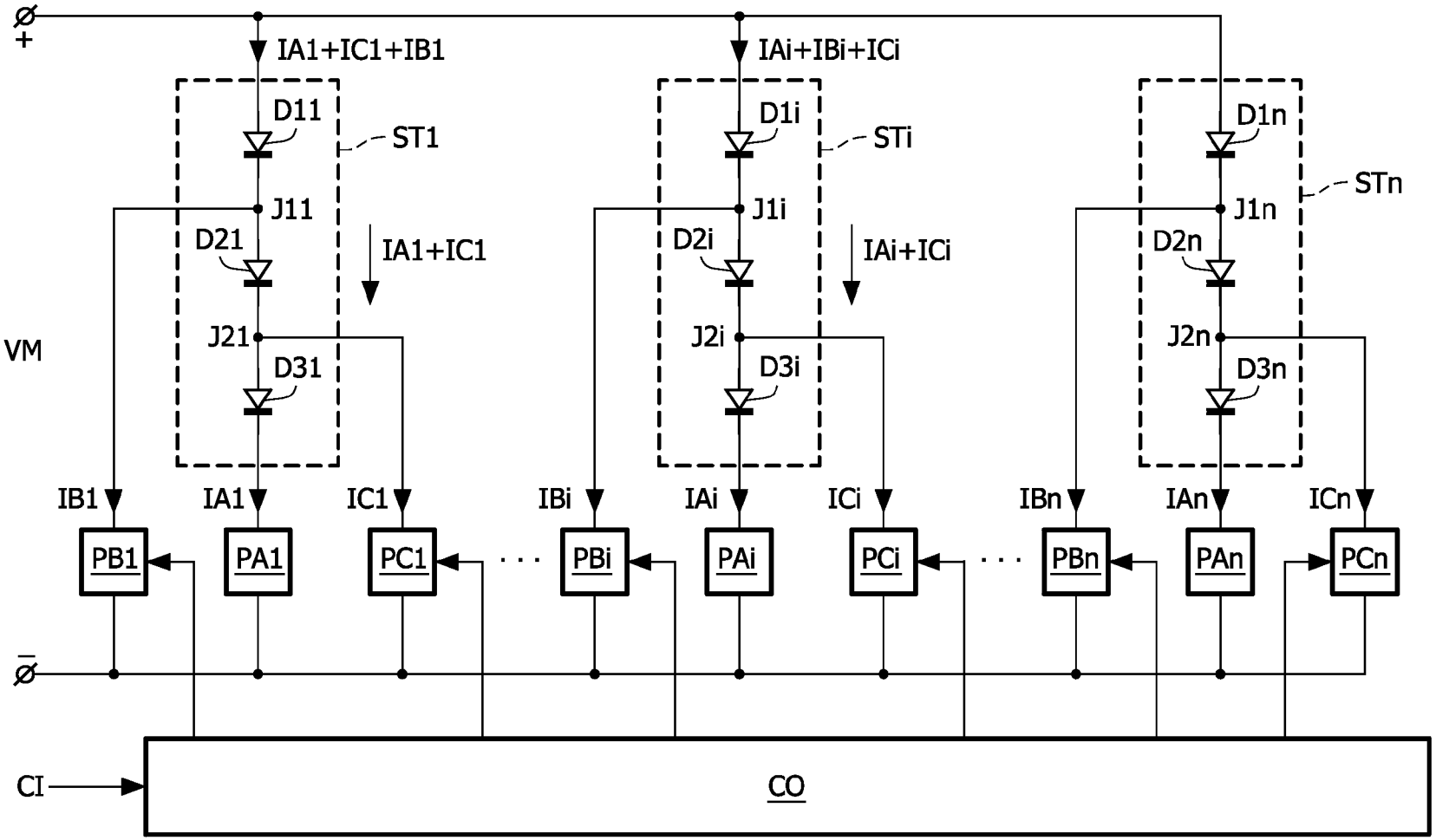
FIG. 1 schematically shows a block diagram of a backlight unit which comprises a plurality of strings of LED's and a plurality of power supplies driving the strings, FIG. 2 schematically shows a backlight unit in which a string of three LED's is driven by a switched mode power supply and two current sources, and FIG. 3 schematically shows a display apparatus with a backlight unit.

FIG. 1 schematically shows a block diagram of a backlight unit which comprises a plurality of strings of LED's and a plurality of power supplies driving the strings. Each of the n strings STi comprises, by way of example, three differently colored LED's D1*i*, D2*i*, D3*i*. The first string ST1 comprises a series arrangement of the three LED's D11, D12, D13, the $i^{th}$ string STi comprises a series arrangement of the three LED's D1*i*, D2*i*, D3*i*, and the $n^{th}$ string STn comprises a series arrangement of the three LED's D1*n*, D2*n*, D3*n*. In the now following the indices 1 to n are used to indicate a particular one of the n items. However, the index i is also used to indicate the item in general. Thus: "the LED's D1*i*" means the LED's D11 to D1*n* in general, or said differently, "the LED D1*i*" means an arbitrary one of the LED's D11 to D1*n*, and "the LED D11" means the particular LED D11.

Three power supplies PAi, PBi, PCi are associated with each of the strings STi. The main power supply PAi is arranged in series with the string STi and generates a main current IAi through the LED D3*i*. The secondary power supply PBi is connected to the junction J1*i* between the LED's D1*i* and D2*i*, and the secondary power supply PCi is connected to the junction J2*i* between the LED's D2*i* and D3*i*. A controller CO receives control information CI and is connected to respective control inputs of the secondary power supplies PBi and PCi. The control information CI may indicate a desired color (or spectrum) of the light emitted by the complete string STi. The controller CO controls the currents IBi, ICi supplied to or withdrawn from the junctions J1*i* and J2*i*, respectively, such that the desired spectrum is obtained. The current through the LED D2*i* is the sum of the main current IAi and the current ICi, and the current through the LED D1*i* is the sum of the main current IAi and the currents ICi and IBi. The controller CO may also control the main current IAi of the main power supply PAi.

Thus, the majority of the current (IAi) through the string STi is supplied by the main power supply PAi. The secondary power supplies PBi and PCi only need to generate the delta currents IBi and ICi to enable a control of the spectrum of the light emitted by the string STi. By limiting the amount of current IBi, ICi generated by the secondary power supplies PBi, PCi, respectively, these secondary power supplies PBi, PCi can be relatively small and cheap. However, still, the spectrum of the mixed light of a particular string STi can be controlled or kept constant over time. For example, the secondary power supplies need be controlled in a limited range only to compensate for aging or temperature effects and to keep the spectrum of the mixed light substantially constant.

The main power supply PAi, and the secondary power supplies PBi, PCi are fed from a mains voltage VM which may be a rectified mains voltage, or any other DC or AC voltage.

Figure 2:
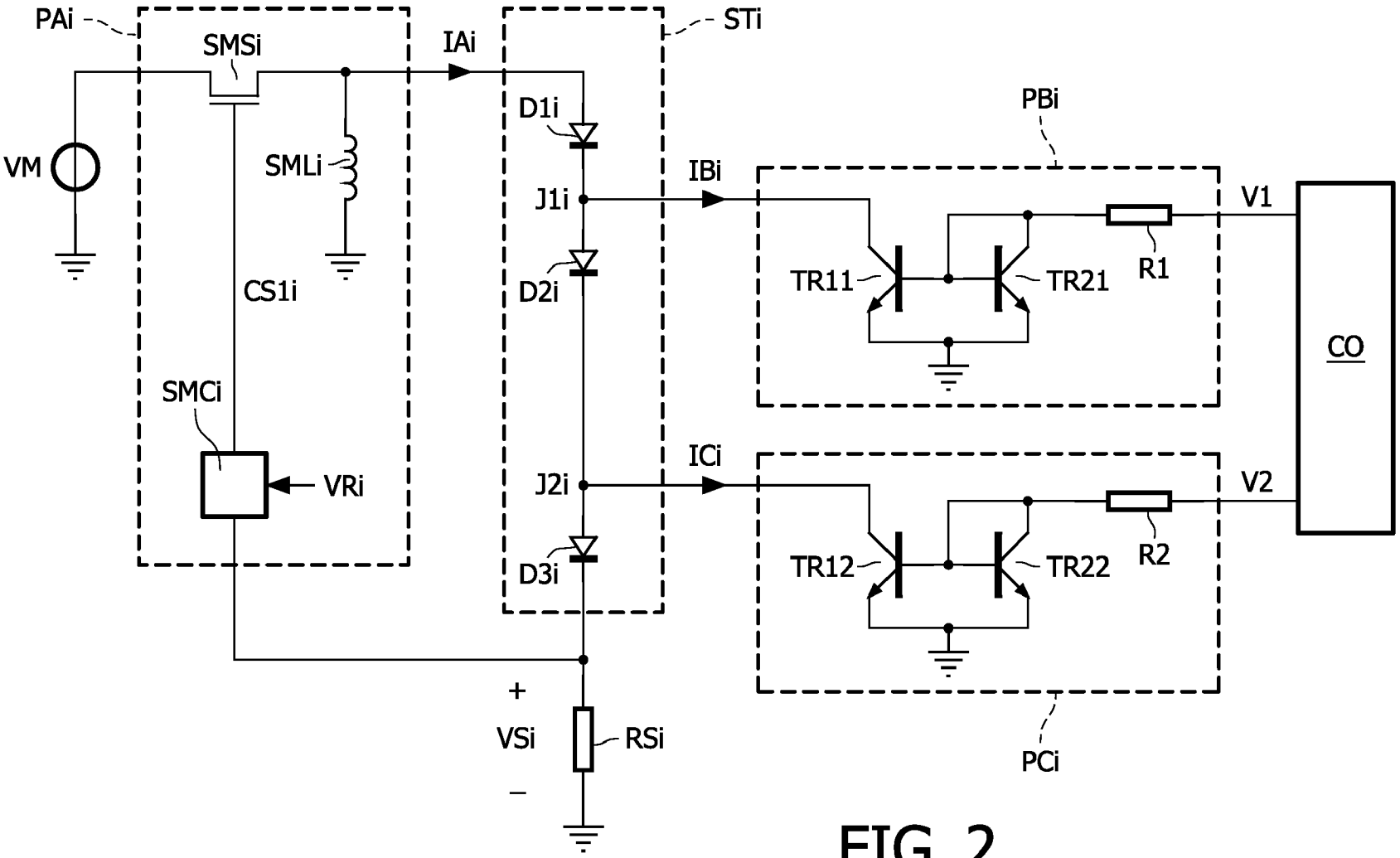

FIG. 2 schematically shows a backlight unit in which a string of three LED's is driven by a switched mode power supply and two current sources. The string STi comprises three LED's D1*i*, D2*i*, D3*i* which are arranged in series. At least two of the three LED's D1*i*, D2*i*, D3*i* emit different spectra and have different colors. The main power supply PAi is a SMPS and now supplies the main current IAi to the diode D1*i* of the string STi. A sense resistor RSi is arranged in series with the diode D3*i* of the string STi to sense the current through the diode D3*i*.

The SMPS PAi is, by way of example only, a buck converter which comprises a main switch SMSi which is arranged to intermittently connect the string STi to the mains voltage VM. The buck converter PAi further comprises an inductor L which is arranged between ground and the junction at which the main switch SMSi is connected to the string STi. The SMPS PAi further comprises a SMPS controller SMCi which receives the sensed voltage VSi across the sense resistor RSi. The controller SMCi compares the sensed voltage VSi with a reference VRi and generates a control signal CS1*i*. The control signal CS1*i* is supplied to a control input of the main switch SMSi to control on and/or off periods of the main switch SMSi to stabilize the sensed voltage VSi and thereby the current through the LED D3*i*. Alternatively, instead of a buck converter, any other SMPS topology may be used, such as for example a boost-buck converter, a boost converter, buck converter, a resonant converter, or a flyback converter.

The secondary power supplies PBi and PCi are formed by the current mirrors TR11, TR21, R1 and TR12, TR22, R2, respectively. The current mirrors are connected to the junctions J1*i* and J2*i*, respectively. The junction J1*i* is the junction between the LED's D11 and D2*i*. The junction J2*i* is the junction between the LED's D2*i* and D3*i*.

The current mirror PBi comprises an input to receive a control voltage V1 from the controller CO. This control voltage V1 is supplied to the resistor R1 of which the other end is connected to the base/collector of a diode connected transistor TR21 which together with the transistor TR11 forms the current mirror. Thus, the current through the resistor R1 is mirrored by the transistor TR11 to obtain the current IBi which is withdrawn from the junction J1*i*.

The current mirror PCi comprises an input to receive a control voltage V2 from the controller CO. This control voltage V2 is supplied to the resistor R2 of which the other end is connected to the base/collector of a diode connected transistor TR22 which together with the transistor TR12 forms the current mirror. Thus, the current through the resistor R2 is mirrored by the transistor TR12 to obtain the current ICi which is withdrawn from the junction J2*i*.

Again, the main current IAi through the string STi is generated by the SMPS PAi, while still the spectrum of the mixed light of the three LED's D1*i*, D2*i*, D3*i* can be adjusted by varying the currents IBi and ICi drawn by the current mirrors PBi and PCi, respectively. Only one SMPS PAi is required instead of three, and the extra current sources PBi and PCi can be integrated, for example in the controller CO. In the example shown in FIG. 2, all three LED's D1*i*, D2*i*, D3*i* have different spectra and all their currents IAi, IBi, ICi can be controlled. Alternatively, only one current (for example IBi or ICi) may be controlled. Alternatively, two of the diodes D1*i*, D2*i*, D3*i* may have the same spectra; again both the currents IBi, ICi or only one of these current may be controlled.

Each or a subset of the LED's D1*i*, D2*i*, D3*i* may comprise a sub-string of series arranged LED's. For example, the single green LED D1*i* is replaced by a sub-string comprising 3 green LED's, the single red LED D2*i* is replaced by a sub-string comprising 2 red LED's, and the LED D3*i* is a single blue LED.

Alternatively the strings STi may comprise more than 3 LED's or sub-strings of LED's having the same spectra. All separate LED's or LED's of different strings may have different colors or emit different spectra. For example, an amber, yellow, or white LED may be added to the red, green and blue LED. Alternatively, the strings STi may comprise only 2 LED's, or LED sub-strings, which have different colors, for example, one of the LED's has a broad spectrum LED and the other LED has a single color. In an embodiment, the broad spectrum LED may emit white light and the other LED emits red light. The secondary power supply SBi, SCi is controlling the delta current through the red LED to adjust the white color point of the white LED. In another example, the string STi comprises a warm white LED which emits a reddish white light a cool white LED which emits a bluish white LED.

Figure 3:
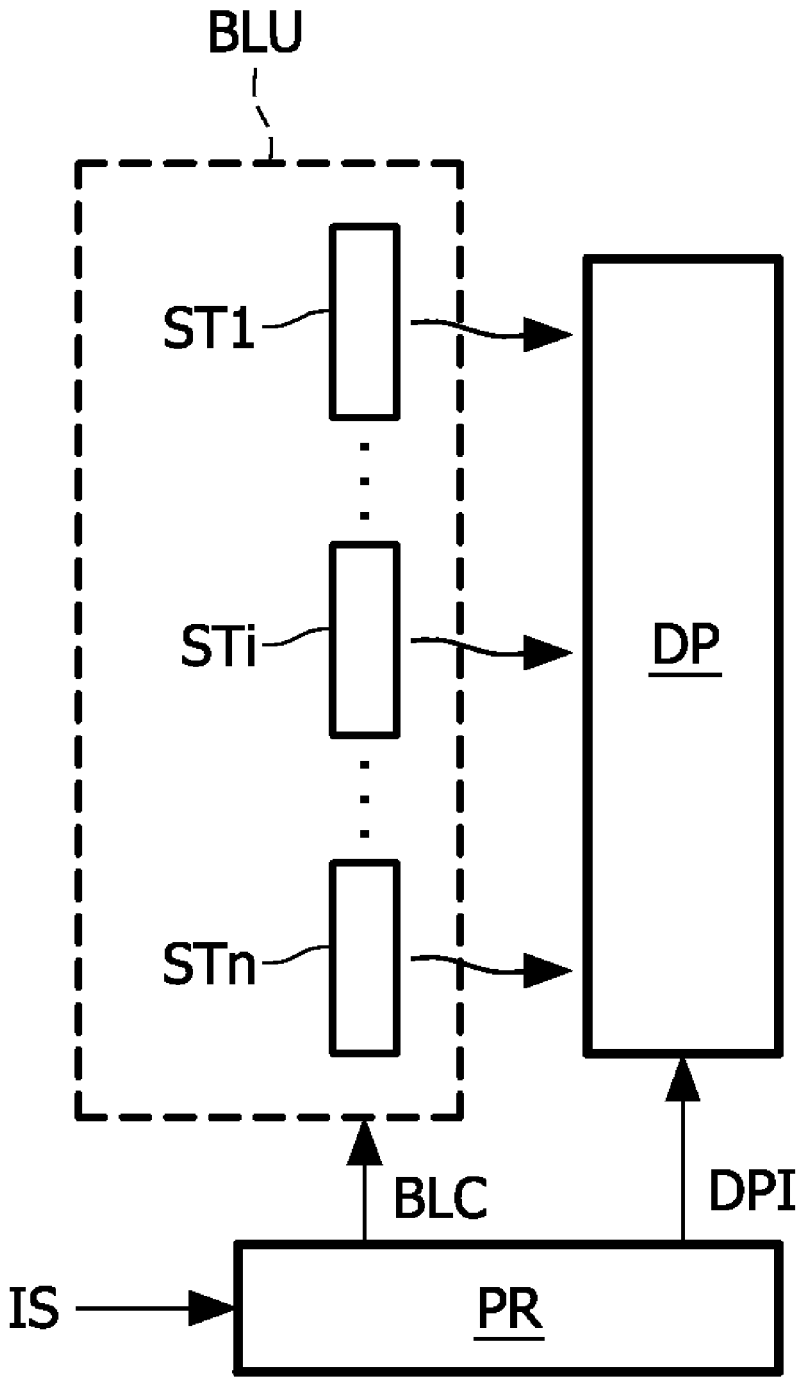

FIG. 3 schematically shows a display apparatus with a backlight unit. The display apparatus comprises a backlight unit BLU, a display panel DP and a processing unit PR. The backlight unit comprises the strings STi of series arranged LED's. The different spectra of the series arranged LED's may be identical and may have an identical order in all the strings STi. The light emitted by the strings STi illuminates the display panel DP. The display panel DP may be an LCD or a DMD. Alternatively, different strings STi may comprise differently colored LED's but when used for an LCD, the light of the different strings should be mixed to obtain a uniform illumination of the display panel DP.

The processing unit receives an image signal IS and supplies a control signal BLC to the backlight unit BLU and data signal DPI to the display panel DP. This control signal BLC is used by the controller CO (see FIGS. 1 and 2) to generate the control signals (C1 in FIG. 1, V1 and V2 in FIG. 2) which determine the delta currents IBi, ICi generated by the secondary power supplies PBi and PCi. In other applications it might be desirable to also control the main current IAi supplied by the main power supply PAi, for example to minimize the power consumption if dark scenes are displayed. In such applications, the controller CO further has an output supplying a control signal to the main power supply PAi. For example, in the embodiment shown in FIG. 2, the controller CO may control the reference voltage VRi. The data signal DPI supplied to the display panel DP comprises the image information to be displayed and may comprise synchronization information.

It should be noted that the above-mentioned embodiments illustrate rather than limit the invention, and that those skilled in the art will be able to design many alternative embodiments without departing from the scope of the appended claims.

For example, the present invention is not limited to use in a backlight unit and is also suitable for general lighting applications wherein a string of LED's of at least two spectrally different types of LED's are used.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A driver for a string of series arranged light emitting diodes of which at least three emit light having different spectra, the driver comprises:

a main power supply having an output coupled across the string for supplying a main current to the string, a first secondary power supply coupled to a first junction between a first light emitting diode and a second light emitting diode and a second secondary power supply coupled to a second junction between the second light emitting diode and a third light emitting diode to supply or withdraw a delta current from the first and second junctions, respectively, the delta currents being smaller than the main current (Iai), the main power supply and the first and second power supplies arranged such that the main current is the current through at least one of said light emitting diodes and the sum of the main current and the delta currents is the current through at least one of said light emitting diodes, and a controller for controlling the first and second secondary power supplies to generate the delta current to obtain a desired spectral composition of the mixed light emitted by the string.

2. A driver as claimed in claim 1, wherein the main power supply comprises a switched mode power supply.

3. A driver as claimed in claim 2, further comprising a sense resistor arranged in series with the string, and a comparator for comparing a sensed voltage across the sense resistor with a reference voltage to obtain a control signal for controlling a main switch of the main power supply to stabilize the main current.

4. A driver as claimed in claim 1, wherein the first and second secondary power supplies comprise a controllable linear power supply.

5. A driver as claimed in claim 4, wherein the linear power supply comprises a controllable current source.

6. A backlight unit comprising:

a string of at least three differently colored light emitting diodes (LEDs);

a main power supply arranged in series with the string of LEDs and supplying a main current to the string;

a first secondary power supply connected to a first junction between a first LED and a second LED;

a second secondary power supply connected to a second junction between the second LED and a third LED; and a controller connected to respective control inputs of the first and second secondary power supplies and controlling respective currents supplied from the first and second secondary power supplies to or withdrawn from the first and second junctions so that a desired spectrum is obtained.

7. The backlight unit of claim 6 wherein the current through the second LED equals a sum of the main current from the main power supply and the current from the second secondary power supply.

8. The backlight unit of claim 7 wherein the current through the first LED equals a sum of the main current from the main power supply and the currents from the first and the second secondary power supplies.

9. The backlight unit of claim 6 wherein the controller further controls the main power supply.

10. The backlight unit of claim 6 further comprising a sense resistor arranged in series with the third LED.

11. The backlight unit of claim 10 further comprising a comparator for comparing a sensed voltage across the sense resistor with a reference voltage to obtain a control signal for controlling a main switch of the main power supply to stabilize the main current.

* * * * *